US006257160B1

(12) United States Patent
Keire

(10) Patent No.: US 6,257,160 B1
(45) Date of Patent: Jul. 10, 2001

(54) SAIL OF WOVEN MATERIAL AND METHOD OF MANUFACTURE

(76) Inventor: Fred Aivars Keire, 108 Butternut Hollow Rd., Greenwich, CT (US) 06830

( * ) Notice: Subject to any disclaimer, the term of this patent is extended or adjusted under 35 U.S.C. 154(b) by 0 days.

(21) Appl. No.: 09/521,446

(22) Filed: Mar. 7, 2000

(51) Int. Cl.[7] ..... B63H 9/04
(52) U.S. Cl. ..... 114/102.29; 442/2
(58) Field of Search ..... 114/102.29; 428/295, 428/297, 902; 442/2–4

(56) References Cited

U.S. PATENT DOCUMENTS

| | | |
|---|---|---|
| 3,626,886 | 12/1971 | Cafiero . |
| 3,903,826 | 9/1975 | Andersen . |
| 3,954,076 | 5/1976 | Fracker . |
| 4,476,799 | 10/1984 | Bandy . |
| 4,593,639 | 6/1986 | Conrad . |
| 4,672,907 | 6/1987 | Smale . |
| 4,679,519 | 7/1987 | Linville . |
| 4,708,080 | 11/1987 | Conrad . |
| 4,945,848 | 8/1990 | Linville . |
| 4,953,489 | 9/1990 | Bassett . |
| 5,097,781 | 3/1992 | Baudet . |
| 5,333,568 | 8/1994 | Meldner et al. . |
| 5,355,820 | 10/1994 | Conrad et al. . |
| 5,403,641 | 4/1995 | Linville et al. . |

OTHER PUBLICATIONS

Peter Isler, "Faster, lighter, smoother high–tech sails" *Sailing World,* Jul.//Aug. 1997, vol. XXXVI, No. 7, U.S.A. pp. 40–44.

*Primary Examiner*—Jesus D. Sotelo
(74) *Attorney, Agent, or Firm*—Fred A. Keire

(57) ABSTRACT

Fiber oriented sails made of woven panels of scrim type weave wherein warp yarns in the panels follow primary load paths in a sail and a method for making woven panels and sails.

20 Claims, 8 Drawing Sheets

SAIL OF WOVEN MATERIAL AND METHOD OF MANUFACTURE

This application is related to my concurrently filed application Ser. No. 09/520,246.

This invention relates to sails for sail driven vessels including sail assisted vessels; more particularly, this invention relates to novel sails, novel materials for sails, and the method for production of sail materials and sails. This application is related to my concurrently filed application Ser. No. 09/520,246 now allowed.

BACKGROUND FOR THE INVENTION

In chronological order in the past century, sails have been made of woven textile materials. Base fibers for these textile materials were derived from natural polymers, i.e., cellulose, of which cotton and linen were preeminent. In general, the fibers in these textile yarns used for weaving sailcloth were of short length as it is typically found in natural polymers. However, significant advantage in sails was realized by longer length fibers and high quality sails were sold as being made of long length "Egyptian cotton" yarns.

With the advent of synthetic fibers, that is an extruded bundle of "continuous" filaments for yarns, the length of fibers in yarns became immaterial, as typically all yarns were a bundle of "mono" filament yarns of substantial "fiber" length. Chopped fiber yarns or "spun yarns" were not used in sailcloth. Hence, the meaning of monofilament yarns, continuous filament fibers and yarns became interchangeable for sail making purposes. However, besides the fiber length in yarns, a synthetic filament in a bundle of monofilaments possessed many advantages such as initial modulus, tenacity, flex life, elongation at break, elongation resistance, resistance to creep, decay resistance, e.g., ultraviolet and mildew, weight-to-strength ration, etc. etc. These characteristics are for the modern filament yarns superior to the best cotton fabrics.

Accordingly, with the advent of continuous length filament fibers such as polyester and nylon (a polyamide), sailcloth are made of bundle of filament materials called yarns. Today substantially entirely all sails in economically advanced countries are made of synthetic fiber materials.

As new polymers were developed and as these lent themselves to filament formation and possessed the desirable properties for yarn formation, these materials found increasing use in sail making. For example, Kevlar™ (a polyaramid fiber sold by DuPont Co.) and Tawron™ (a polyaramid fiber sold by Akzo Co.) were used in sailcloth first with indifferent success, but as the fiber properties were improved such use became increasingly prevalent.

As new and improved derivatives of the above materials such as Kevlar 29™ and Kevlar 49™ and PEN polyesters (i.e., polyethylene naphtalate polymer) and entirely new synthetic fibers were developed with properties suitable for sail making, these materials found use in sails albeit at a very high premium over conventional polyester fiber fabrics. Examples of such monofilament materials are: Vectran™ (a polyaramid type of fiber sold by Hoechst-Trevira Corporation), Spectra™, Dyneema™, Certran™ (a high modulus polyolefin fiber sold by Allied Corp., DMS Company and Hoechst-Trevira Corporation respectively) and PBO (polyphenylene benzo bisoxazole) sold as Zylon™ by Toyoba Company. A considerable effort has also been expended to develop carbon fibers for sail making use, e.g., carbon fibers coated with a polyester or a polyamide polymer.

In sail making, when evaluating the above and novel fibers, the following tests are used:

Initial Modulus:

a measure of the yarn's ability to resist stretch. It indicates how well the fiber will hold shape, and is measured in grams of load per unit of stretch for a given denier. The higher the number, the less the stretch. Also defined as the slope of the initial straight portion of the stress-strain curve.

Tenacity:

The yarn's initial breaking strength, expressed in grams of force per denier. This is a good measure of a fiber's ultimate strength. The higher the number, the more load it takes to break the fiber.

Flex Life:

A measure of the fiber's ability to retain its strength after being folded back and forth. It is expressed as a percentage of the fabric's strength lost after 60 bend cycles.

UV Resistance:

Expressed as the amount of time it takes for a yarn to lose 50 percent of its modulus; normally conducted with artificial UV exposure.

Elongation to Break:

A measure of the fiber's ability to resist shock loads. It is measured as how much a fiber will stretch (as a percentage of its overall length) before it breaks.

However, despite the advances in synthetic polymer technology, the inherent shortcomings associated with woven technology are evident, i.e., 90 degree warp and fill orientation and the over and under shape of the warp fibers caused by weaving called "crimp." These inherent shortcomings cause considerable problems associated with sail shape distortion. Shape distortion is caused by the anisotropic properties of the material when the force is applied at less than 90 degrees to the fill and/or warp orientation. It should be noted that typically sailcloth was woven with the better properties in the fill direction as the warp yarns, because of the "crimp" in the yarns, did not have the same elongation characteristics as the fill yarns. To remedy the inferior warp direction properties, "warp inserted" fabrics were also produced.

Within about the last 25 years considerable effort has been devoted to address the bias distortion in sails arising from the conventionally woven fabrics. This effort has had a three-prong approach. First, sailcloth manufacturers sought to improve the sailcloth by resin and heat treatment and resin applications. Additionally, sailcloth manufacturers added laminated films, typically a polyester film to the fabric on one, both sides, or in between two fabric layers. As the second approach, the sail makers employed panel orientation to align the fill threads with the load path, e.g., in tri-radial sails to minimize the bias inherent in a triangular sail typically used on recreational sailboats. Finally, as a third approach, sail makers devised structural sails (also known as fiber oriented sails) for racing; these were real "breakthrough" sails.

For structural sails, the initial development was to place the structure in the form of fabric strips, bundled monofilament fibers, i.e., yarns or yarns in the form of tapes on the skin or membrane of the sail. These added structures followed the load path in the sail. The load or stress maps for a sail had been available to sail makers for a number of years. The whole structure was typically confined either on one side or the other side or both sides of the sail. A subsequent development confined the structure between two layers of a film.

Bias distortion as used in the sailing parlance is typically caused by a load (also force or stress) that is "off-the-thread line." That is, if the warp (or ends) and the fill (or weft) fibers are in a line with the major, predominant load, sails are said to have the stress "on-the-thread" line," i.e., be less bias distorted. Typically, a sailcloth is woven with the fill threads under tension and therefore these do not suffer from the "crimp" of the warp threads. These fill threads are not as much subject to elongation as the warp threads when the sail is under load. However, in a typical sail there are other loads or forces "off-the-thread" line. By adding a laminated film to the material, typically a polyester film or a poly vinyledene chloride film (e.g. sold under a trademarks Mylar or Tedlar, respectively, and produced by a DuPont Company), bias distortion was reduced because these films display substantially isotropic properties. Improved polyester films such as PEN, (which is a polyethylene naphthalate polymer, i.e., a type of polyester polymer), may also be used in a film form and is also available as a fiber. As previously mentioned, the yarns may be substantially immobilized by hot calendaring, resin impregnation, resin coating, as well as the laminating with the above-mentioned films. Reduced anisotropic characteristics are thus obtained. Nevertheless, in sailcloth, bias distortions cannot be entirely minimized by the above described steps as dynamic loading of a sail is still not easily quantifiable in the various sections of the sail.

To overcome or reduce the bias distortion, sailcloth manufacturers also resorted to multi-ply sailcloth materials. These efforts have been made towards improving the warp characteristics by producing the so-called "warp insertion" materials and also by inserting composites in the X direction (the machine or warp direction and opposite to the cross-machine or Y direction during manufacture) the so-called X-Ply materials or diaxial material (hereafter X-Ply). The X-Ply materials are an open mesh in a form of a scrim or a scrim supplemented by parallel yarns. These scrim materials which have a fiber orientation at 90 degrees or less, at various angles to the warp, are typically placed across the fiber carrying the major intended load, and are covered with a polyester film in the sailcloth material. These multiple ply materials often carry, as the X-Ply material, expensive fibers such as Technora™ of Teijin Company or Vectran™. These multiple, composite materials carry the major load in the warp direction and are not only expensive but also rely on "over" design in the warp direction to over compensate for the bias distortion. Despite these weight and cost penalties, the X-Ply materials provide only, at best, an inexact, gross approximation to a load path when these materials are incorporated in a sail, typically in a gore form such as for tri-radial sails.

To minimize the cost of material and improve thread alignment, computerized nesting programs for cutting gores are available, i.e., for optimizing panel cutting such as for tri-radial sails. Still considerable wastage is experienced when making sails. Additionally, once distorted beyond a yield point, the films used in the laminate tend to break down or retain an irreversible shape without any recovery. Moreover, crinkling of the film and fabric composites and /or exposing these to sun also causes these materials to shrink to a greater or lesser degree. Bias distortion in these "panel optimized sails" is still introduced by the forces or stress exerted by aerodynamic loading of the sails as transferred to the "off-the-thread-line", and at boundary load concentration points, i.e., point loads of the sail. These stress concentration points consist primarily of a clew, head and tack points of the sail. Further, stress concentration is found at reef points, i.e., reef clew and reef tack, hanks, slides, battens, etc. In other words, the attachment means for the sail to a mast, stay, boom, or brace are typical stress concentration locations. These attachment points are also known as boundary point stress locations.

The reason for having repeatable consistency, i.e, properties in the warp, fill and bias e.g. 45 degrees direction for producing sailcloth and sails is made obvious when a distortion of two to four percent in a camber of a sail will result in significant performance differences. While a sail maker can measure the cloth properties in the machine direction and cross direction, i.e., or warp and fill yarns and has some confidence in the bias measurements, by experience, the consistency of available sailcloth material leaves a lot to be desired and leaves a sail maker at the mercy of a sailcloth manufacturer.

For the above reasons, the production of fiber oriented sails or structural sails (with added fabrics or scrim materials supplementing the primary yarns) has come to be regarded as the best present-day solution to the bias problem. These observations have been especially noticeable with respect to the high-end sails used for Grand Prix racing, e.g. America's Cup racing. However, the addition of the materials such as scrims and X-Ply materials to the fiber-oriented sailcloth has complicated already an essentially batch sailcloth and sail making process. Often, during sailcloth manufacture, each of the laminating, yarn insertion, and scrim insertion steps is a separate operation causing each to be a separate batch operation step with high labor content and with great increase in the cost of the sailcloth.

Still further, with the increased availability of the esoteric yarns, e.g., of fibers such as PBO, the cloth costs increase dramatically as represented by the actual yarns carrying the loads in a woven sailcloth. In the woven material, the yarns which do not carry the load are said to "run off" the material and are not continuous from panel to panel, i.e., are not joined along the curves of the load path. The "off-the-thread" material in essence only partially participates in the load bearing but contributes to bias distortion. Consequently, a great percentage of the yarns away from the 90-degree orientation in a cloth are carrying a disproportionately higher price versus their ultimate load-bearing capability. However, the recently adopted gluing of seams, as opposed to sewing, has displayed better load transfer properties between panels or gores.

When producing fiber-oriented sails, the sails are sought to be made with yarn orientation in the sail in a manner such that the properties in each section of the sail are predictable and properly balanced. For "balance" considerations, the starting point is based on the available stress maps or load-path maps which give the principal stress and/or principal load paths and stresses about perpendicular to the principal stresses known as secondary stresses or secondary load paths.

The most sophisticated software systems currently used for sail design combine a finite element analysis to model stresses within the sail membrane, with numerical flow codes to predict pressure variations over the curved sail surfaces. The two subprograms must be closely integrated because any sail shape change will alter the pressure distribution, and vice versa. Mainsail and headsail also interact aerodynamically to add another dimension of complexity.

Using these tools, a skilled designer can, in principle, fine-tune the curves of a sail so that the entry angles will harmonize with flow at every point up and down the luff as well as define the vertical camber at any location. Camber deflection analysis is also available as a design tool.

Using the computerized stress modeling, the engineering of the sail can be optimized in terms of fiber density and orientation. Areas of maximum load or potential overload can be identified and subsequently reinforced. By the same token, lightly stressed zones can be pared down in the quest to save weight for Grand Prix racing sails.

As discussed above, in a sail, in different parts thereof, stress is experienced in a multitude of different directions. In a woven sail material, the balance consideration of properties requires that the optimum or least anisotropic properties are consistent from one batch of sail material to the other. A good sailcloth is said to be "flat," i.e., has been weaved with consistent tension in the warp and fill, producing no "bumps" or "bubbles." Further, the material properties are said to be of the same value, i.e., magnitude, for example for modulus, stretch or elongation, bias distortion, etc. Any change or deviation from batch to batch of the sailcloth material (or fiber oriented sail material) distorts the sail unpredictably and causes the sail to perform unpredictably. Accordingly, if each sail material batch has different properties, the sail design cannot be made consistent. As mentioned above, by experience, it has been found that the horizontal depth or curvature of a mainsail, i.e., horizontal camber by as little as two to four percent will cause a significant change in the performance of the sail. Likewise, the change in the vertical camber will have drastic consequences in performance. The loss of performance is magnified if the curvature or camber migrates to a location in the sail different from that for which it was intended, e.g., towards the leach of the sail. For these reasons, eliminating variability, i.e., having predictable properties in a batch of conventional or fiber oriented sail material has been a desideratum of all sail makers.

In the production of fiber-oriented sails, the consistency in yarn properties, the consistency of the structure, and the final laminate is just as much of importance as with woven sailcloth materials. As the design of the fiber oriented structure in a sail is still bound up with considerable intuitive art, the predictability, while significantly improved over woven-material sails, nevertheless allows for great improvements in the component parts of the structure. Although development of structural, i.e., fiber-oriented sails in effect freed the sail maker from the sailcloth manufacturer, it placed a greater burden on the sail maker to produce consistent materials. Some of the alleged improvements such as "round" fibers versus flat fibers, twisted fibers versus untwisted fibers, mixed fibers, etc. etc. have been more or less of defensive posturing type rather than based on proven results. Nevertheless, the reduced costs in a structural sails designed with substantially all of the fibers of the filament yarn type carrying the load has been a notable advance.

However, the experience on race courses has shown that initial fiber oriented sails were insufficiently strong when only primary yarns followed the load paths for the principal or primary stress. If no other than primary yarns were present and if the substrate, i.e., skin membrane was week, i.e., a polyester film, the sail was distorted. In other words, distortions due to aerodynamic loading had to be prevented by introducing a complex secondary structure, i.e., a strong membrane or secondary structural members to prevent distortion.

Distortions in fiber oriented sails appeared mostly but not exclusively in the horizontal direction, i.e., across the sail. Adding more primary yarn structure, and a scrim or taffeta combination has been an answer, albeit, an imperfect answer. Addition of scrim requires a separate manufacturing step and today two principal structural sail manufacturers, Sobstad, Inc., selling sails under the trademark Genesis and North Sails, Inc. selling its structural sails under the trademark 3DL, insert a layer of reinforcement, e.g., a scrim as a separate step in the sail/sail material manufacturing process. Both processes are not amenable to inserting a scrim as a bottom layer in a sail material during manufacture. The third structural sail manufacturer Ulmer-Kolius known as UK Sailmakers selling Tape-Drive™ sails uses a cross-cut panel sail of conventionally woven material or an X-Ply improved material to place a structure on it.

BRIEF DESCRIPTION OF PRIOR ART

The two principal processes for making the fiber oriented or structural sails are represented by U.S. Pat. Nos. 4,593,639, 4,708,080, and 5,355,820, assigned to Sobstad Corporation (U-K Sailmakers have been licensees of Sobstad Corporation) and U.S. Pat. No. 5,097,784 assigned to North Sails, Inc. Neither of the two processes lends itself readily to continuous manufacture of sails. Neither the Sobstad nor the North Sails processes are amenable to a more streamlined production of a sailcloth material. While the 3DL™ process is a more direct material-to-sail process, it requires for heavier use sails a scrim insertion and vacuum lamination steps, on a mold, as separate discontinuous steps for the final sail material production. In the production of sails under the Sobstad process, the fabricated sail material must still be subsequently laminated in a separate step as shown in U.S. Pat. No. 5,355,820 with a scrim insertion during lamination. Neither process inserts a scrim between the fibers and bottom film, thereby resulting in an unbalanced sail material. While each of the prior art methods has its benefits and short comings, the separate layering of the scrim on top of the primary structural fiber members on a mold introduces additional problems such as sufficient temperature and pressure for laminating, conforming of the film to the structure, and adhesion of the film material to the structure. In the 3DL™ method disclosed in U.S. Pat. No. 5,097,784 besides the above inability to laminate a scrim between the bottom film and fibers, the complexity resides in the mold contour control, the pre-shaping of the film and scrim in panels which then must be placed on the mold, and the inability to vary economically the yarn content or mixture from place to place in the sail as needed and the complexity in the fiber orientation to produce an approximation of the primary and secondary load paths. These and other shortcomings of the prior art have been minimized by the present invention as will now be described.

BRIEF DESCRIPTION OF THE INVENTION

It has now been found that a novel sail material, a sail made from it, and a method of production for the sail material have been discovered. Sails made from the novel sail material are of the "fiber oriented type," yet are woven. However, the novel material enables a sail maker to by-pass, in a novel manner, the separate scrim manufacturing step and scrim insertion step apart from the manufacturing step. At the same time, fiber oriented, structural sail panel components are produced by weaving with more balanced material properties. Weaving produces in one step, the primary structure of fiber-oriented panels and incorporates in the primary structure fill yarns as the secondary structure. The secondary structure can also be varied, e.g., of different type yarn content and/or yarn diversity. The panels which can be woven in this manner can be woven of considerable length and of suitable sizes for small boats with a hoist of about 6 ft., e.g., for an International Optimist as well as off-shore racing boats and one-design boats up to the America's Cup size sailboat sails and sails up to about 150 ft. on the hoist. Further, these panel materials have the necessary strength associated with the secondary structure typically introduced by the prior art by the separate scrim production and scrim insertion step. Additionally, the more balanced sail material properties may be improved still further by a balanced additions of supplemental materials such as X-Ply materials.

Further, the invention resides, in part, in elimination of the separate scrim insertion step of the prior art but does not exclude it from a panel formation stage of load path specific panels. These advantages are achieved by using a weaving step in the formation of the primary and secondary load path specific panels. The method contributes the following benefits to the sail material, namely, each panel has, as a result of the weaving, a better stabilized load path primary and secondary yarns which can be locked in an improved load path grid with the secondary fill yarns. The formed panel has an improved, that is, less anisotropic and hence predictable properties with reduced bias distortion. The optional X-Ply material addition provides for further more balanced sail material thus resulting in better balanced properties in the sail (from that achieved when adding to a 90 degree woven material. Very little crimp is introduced in the primary structural warp yarns by the scrim like structure of the material. At the same time, such panel formation is amenable of a continuous, i.e., "step-an-index" panel formation. The weaving is by continuous shape adjustments of the warp yarns in the panel during its weaving stage. Other benefits result from a better lamination of the primary and secondary yarn structure and optional facile insertion of an X-ply material without sacrifice of the production rate. The novel woven structural sails have a beneficial strength-to-weight ratio, the thread line benefits of the structural sails, i.e., fiber oriented sails, have less of the manufacturing problems associated with the molded structural sails such as 3DL™ sails and can readily incorporate any of the novel yarns and fill materials appearing on the market.

In the manufacturing process, that is during weaving, the yarns may be set up once and continuous step-and-index operation repeatedly carried out without the requirement of a repeated set up or great multiplicity of molds as in the North Sails process. The structural sails and the panels as these are produced for the sails can be tailored to meet any specifically recognized or general structural shortcomings in a particular panel. Each sail can be designed in the panel manufacturing process to have certain performance, weight-to-strength ratio, horizontal and vertical curve, i.e., caternary configuration (when in use), or boundary point reinforcement features. The process is of exceptional advantage in serial mass production of same size panels or a pair of complementary panels.

DETAILED DESCRIPTION OF THE INVENTION, DRAWINGS, AND EMBODIMENTS THEREOF

With reference to the drawings schematically illustrating various embodiments of the invention and without limiting other aspects of the invention;

Figure 1:
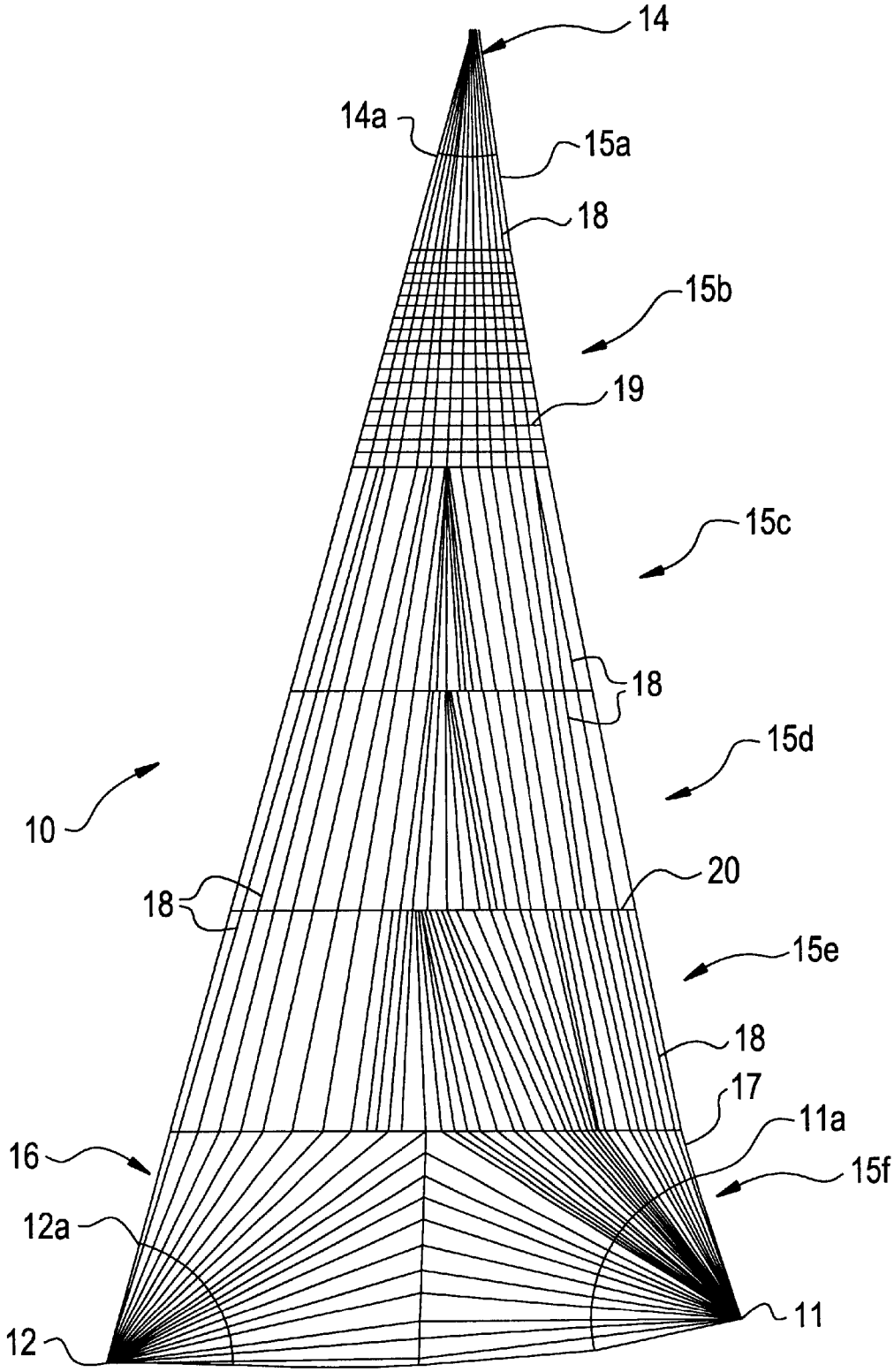
FIG. 1 illustrates, in a plan view, a sail according to the invention herein.
Figure 2:
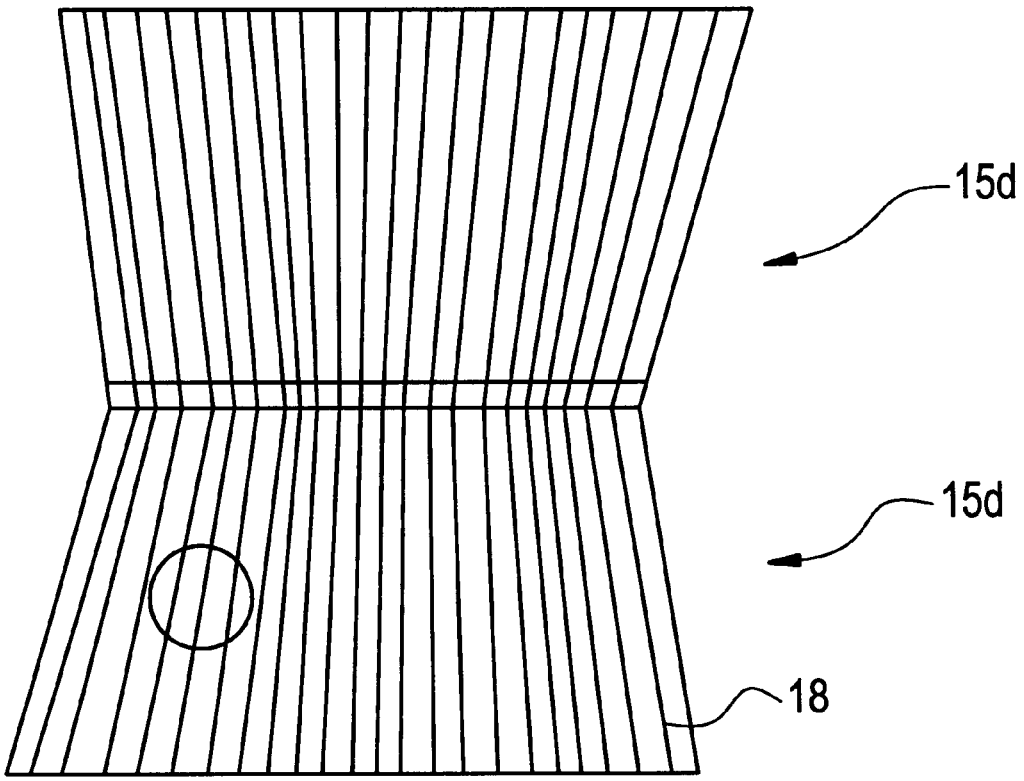
FIG. 2 illustrates, in a plan view for the sail of FIG. 1, a pair of woven panels according to the invention herein.
Figure 2A:
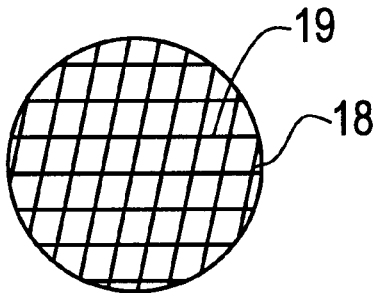
Figure 3:
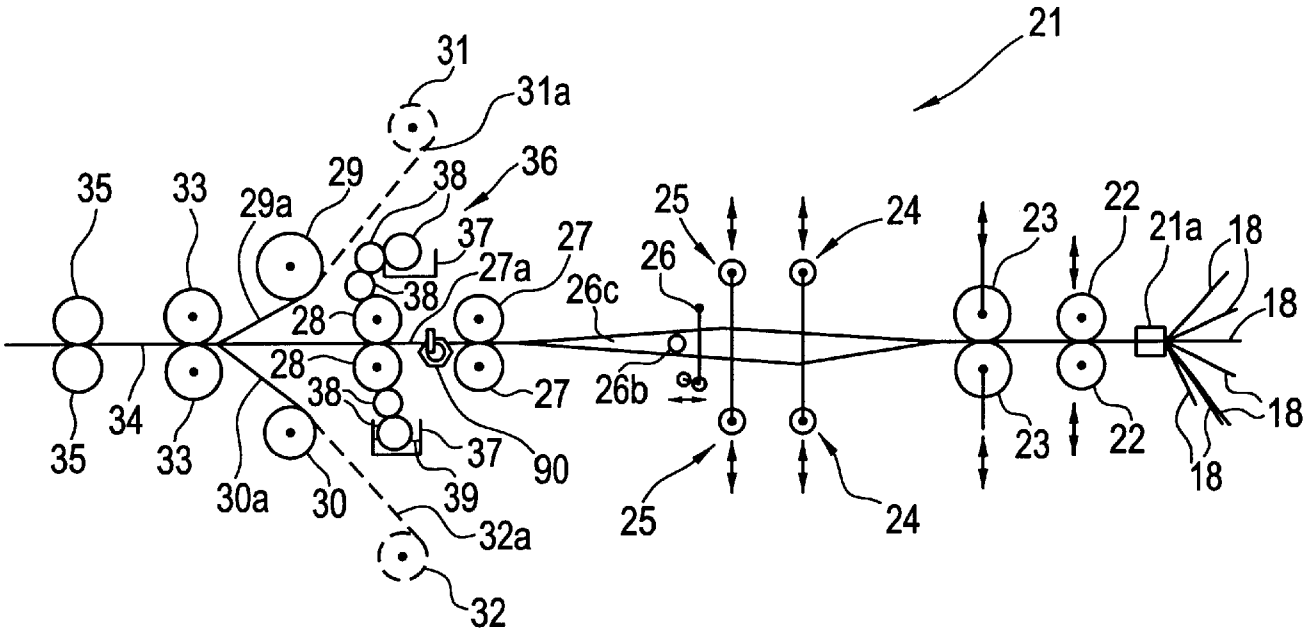

FIG. 2*a* illustrates schematically, for a circular break-out section of FIG. 2 therein, a warp and fill yarn orientation in a panel;

FIG. 3 illustrates schematically, in a cross-sectional view, a weaving loom for the sail material according to the invention herein including attendant yarn-feed means, a resin application section, and a laminating section for carrying out various aspects of the herein described invention as shown in FIGS. 1 to 2*a;*

Figure 3A:
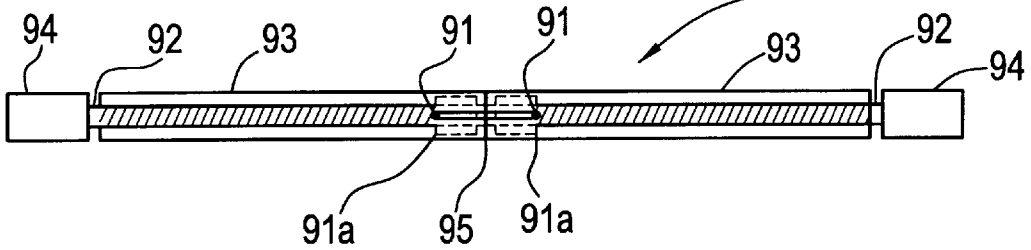
Figure 4:
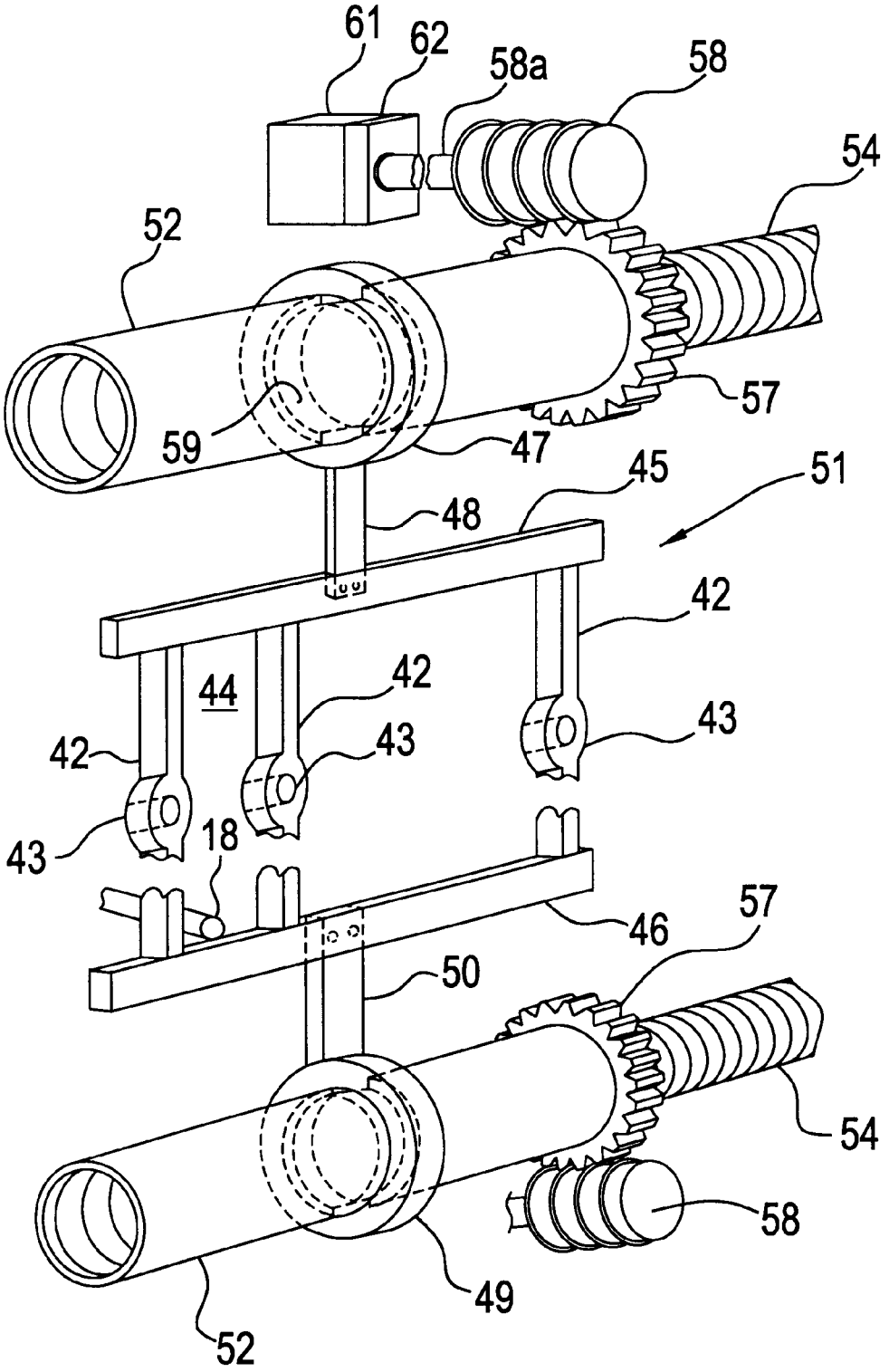
Figure 5:
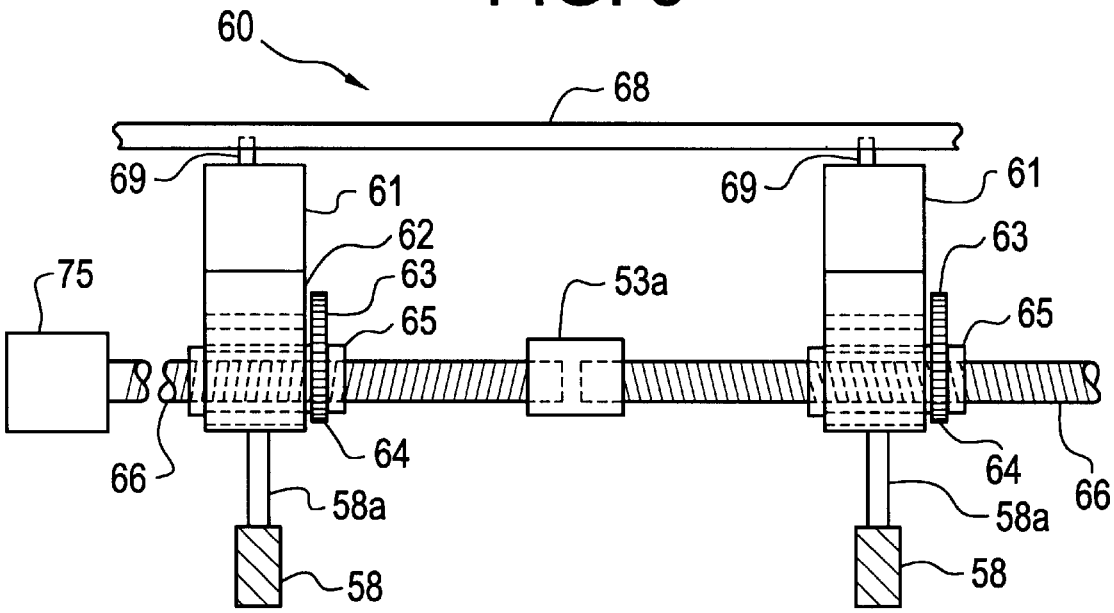
Figure 6:
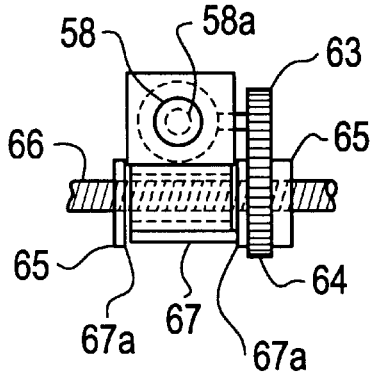
Figure 7:
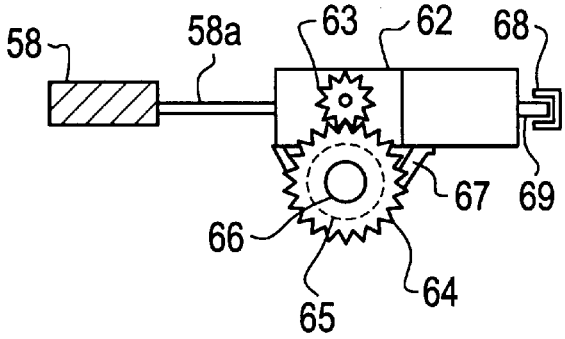
Figure 8:
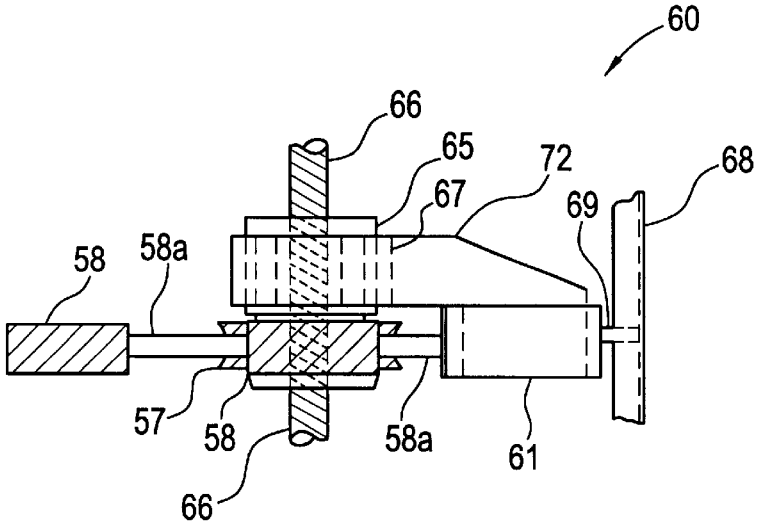
Figure 9:
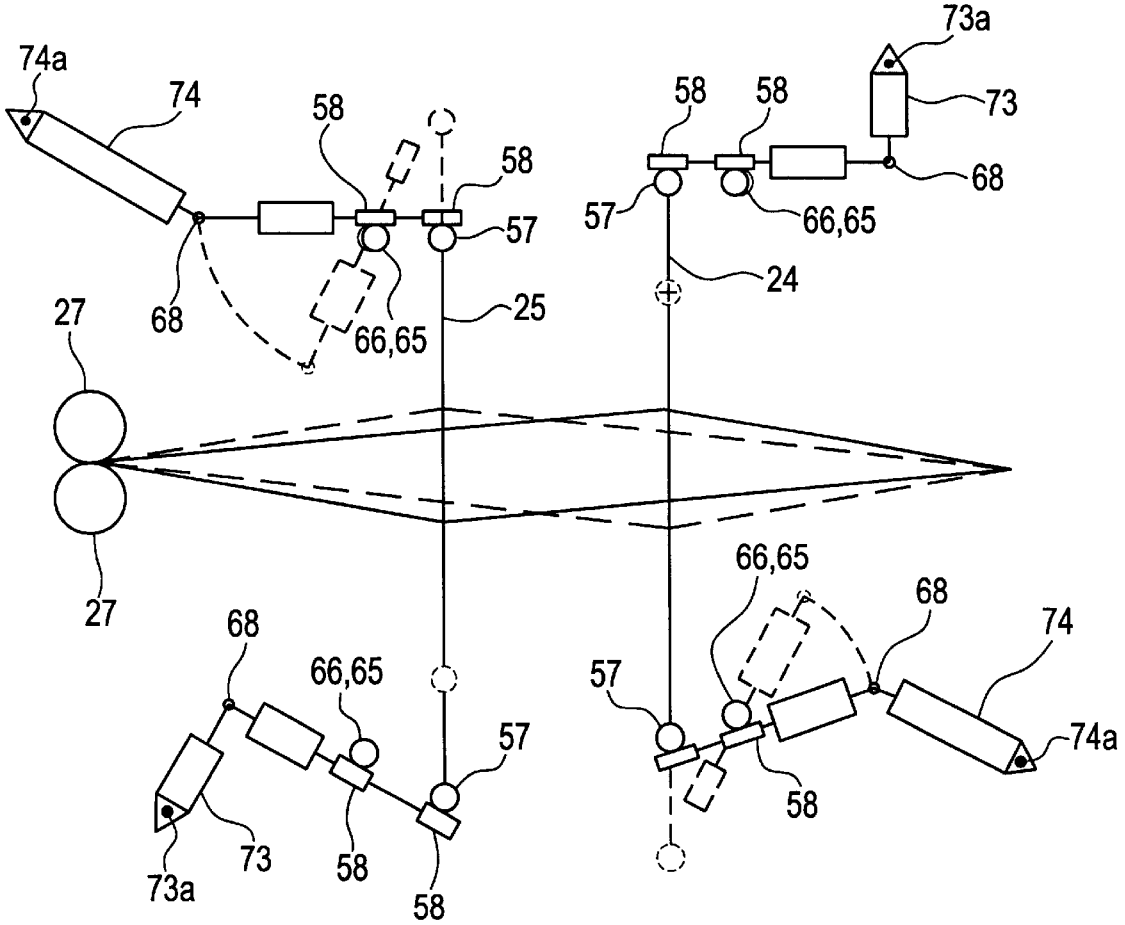
Figure 10:
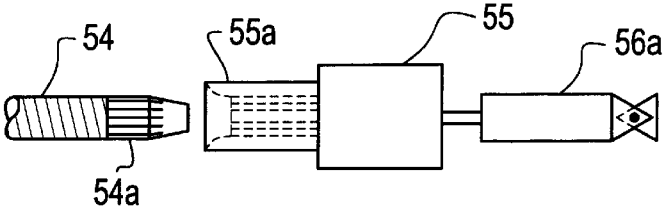
Figure 11:
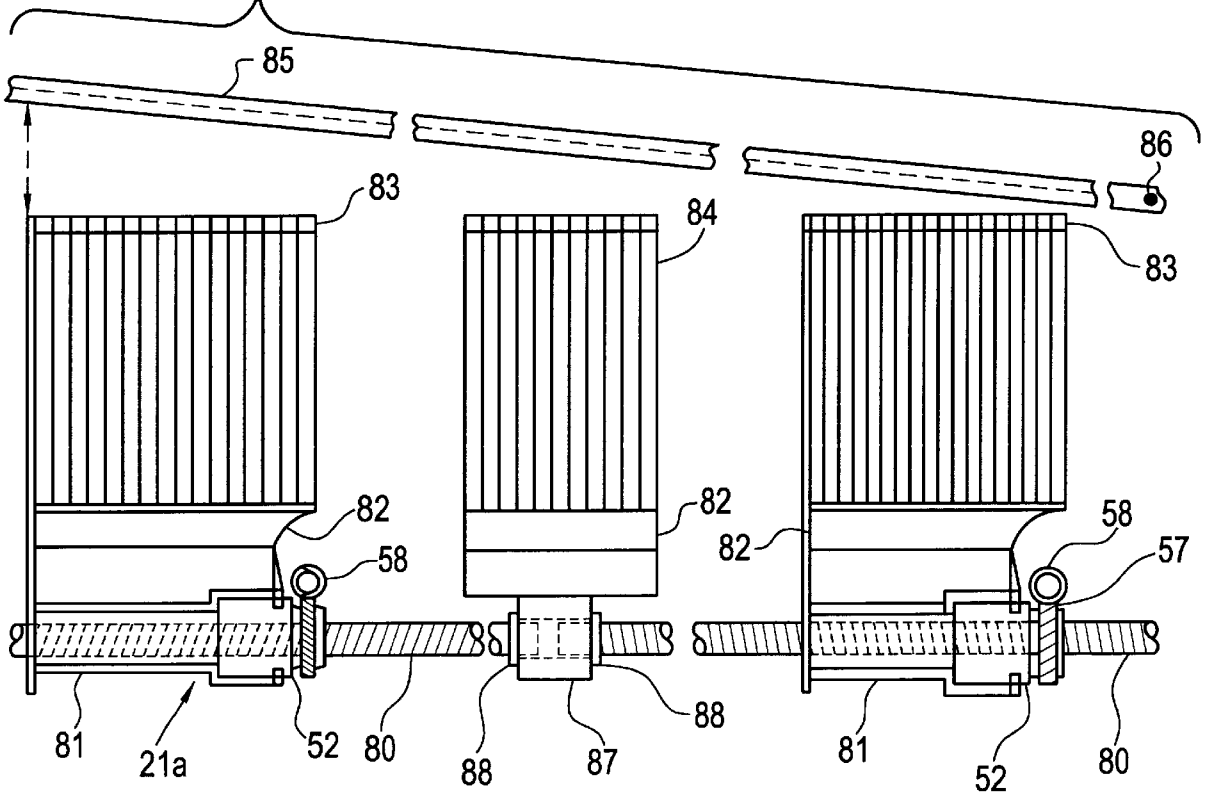
Figure 12:
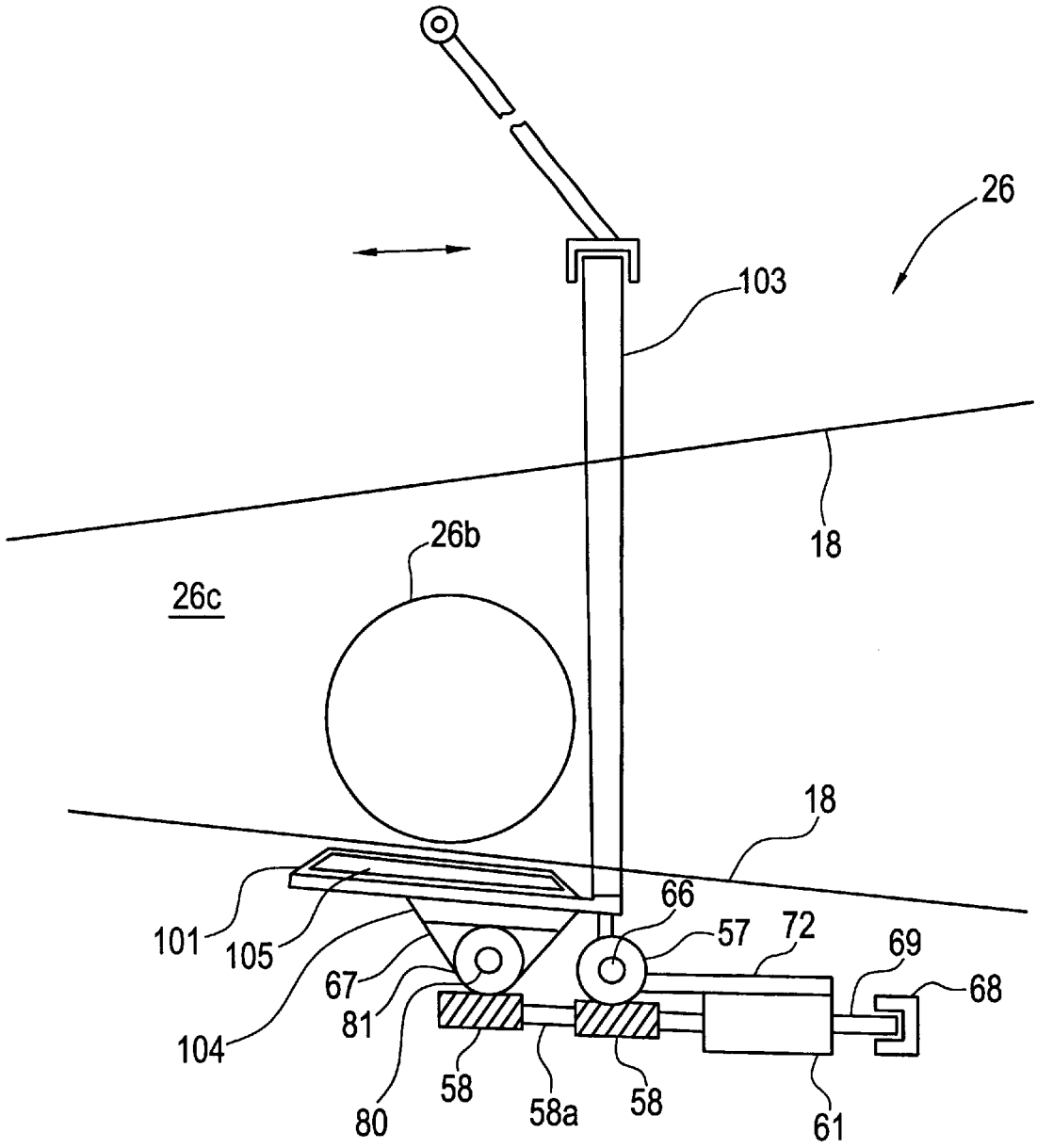

FIG. 3*a*, illustrates in a top view, a yarn gathering device used in FIG. 3 loom for making corner panels for the sail shown in FIG. 1;

FIG. 4 illustrates, in a perspective view, a laterally adjustable heddle segment, including top and bottom heddle ribs for a heddle assembly shown in FIG. 3;

FIG. 5 illustrates, in top plan view, a fine adjustment means shown in FIG. 4;

FIG. 6 illustrates, in a front view, one of the fine adjustment devices of FIG. 5;

FIG. 7 illustrates, in a left-side view, the fine adjustment device of FIG. 6;

FIG. 8 illustrates, in a top plan view, another embodiment of the fine adjustment means for a heddle segment shown in FIG. 4;

FIG. 9 illustrates, in a schematic cross-sectional view, an engagement and disengagement position for the fine adjustment means of FIG. 8 for the heddle segments schematically depicted in FIG. 3;

FIG. 10 illustrates, in a side view, the means for gross adjustment of the heddle segment assembly shown in FIG. 4;

FIG. 11 illustrates, in front plan view, the yarn guide means suitable for the loom of FIG. 3; and FIG. 12 illustrates, in a side view a reed assembly for the loom of FIG. 3.

In the description to follow, like elements, which function in the same manner are indicated by like numerals.

With reference to the detailed drawings and specifically with reference to FIG. 1, a sail 10 consists of a clew 11, a tack 12, and a head 14 describing within the lines, from each to the other, an approximately triangular sail known as a jib or genoa sail. Mainsails (not shown) likewise have a clew, tack and head and are more or less triangular. The stress maps or load path maps for these sails are fairly well known and are generated by available computer programs.

In FIG. 1, sail 10 is illustrated with six panels 15*a* to 15*f*. Panel 15*f* may be subdivided in two sub panels 16 and 17. If desired and for ease of production, especially for large sails, any of the panels 15*a* to f may be divided into sub panels. The number of panels in a sail may be decreased in number and increased in size, at the option of the sailcloth maker or weaver making the herein described panels taking into account the start-up costs, the size of sails, and the size of the loom being used.

Between each panel 15*a* to 15*f* or each sub panel, i.e., 16 and 17, there is a seam 20. Seams are formed by sewing or preferably gluing. In today's sail making practice, the glues available have such tremendous load caring capability that many sail makers employ only glues for seam formation. Various glues are available from companies such as Loctite Co., Fuller Co., and sailcloth manufacturers such as Dimension-Polyant of Putnam, Conn. Gluing of seams is well known to sail makers and need not be explained here. Various gluing practices are used by sail makers when joining panels of film laminated fabrics such as gluing warp yarns to warp yarns and then gluing the overlap selvage of the warp yarn carrying film on top of the glue line on either side of the glued warp yarns, or gluing only film-to-film under pressure. Gluing of polyolefin fibers and films has as yet not been sufficiently developed.

In FIG. 2, an illustration is depicted how like panels, for example 15*d* shown in FIG. 1, are formed continuously by weaving in accordance with the invention herein. In order to minimize set up costs and improve efficiency, two similar panels may be alternatively woven in series of two based on the need to mass produce these specific panels.

For sake of clarity, the fill yarns 19 have not been shown for all panels except for panel 15*b*. In FIG. 2*a*, the fill yarns 19 are also shown for the circle illustrated in FIG. 2 and in a magnified version depicted in FIG. 2*a*. Accordingly, the weaving of the panels 15*a* to 15*f* results in an open mesh weave, that is a scrim of warp threads 18 and fill threads 19. It should be noted that the dents (spacings between the reeds in a loom) per inch or conversely warp yarns per inch may be varied for each sail and each panel. Thus, there may be from about 1 warp yarn per inch to 10 warp yarns per inch by original set up for each heddle segment 51 further described herein. The number of warp yarns per inch will increase for smaller denier warp yarns 18 and decrease for larger denier warp yarns by the employment of appropriate heddle segments 51 as it is well understood in the art. Warp yarn density is from 1 to 16 yarns per inch. Similarly, the density of the fill yarns 19 may be varied from 8 per inch to 0.5 per inch; a range of 3 to 4 per inch is preferred.

As will be further explained herein, heddle segments 51 individually may also be, in turn spaced increasingly or decreasingly apart from each other so as to create an appearance of a plurality of ribbons of spaced apart yarns resembling sails such as sold in the art under the 3DL trademark by North Sails Corp.

Likewise, a heddle segment 51 individually may carry a greater or lesser number of warp yarns with reference to adjacent heddle segment(s) 51 shown in FIG. 4. Where especially heavy warp yarn density is required, e.g., along a leach of a sail, a doubling of warp yarns may be employed or wide ribbon-like warp yarns used. A leach is an aft segment of a sail along an aft boundary of it. However, as these sails are woven sails with fairly large scrim apertures, there is very little crimp in the warp yarn. It should be noted that the warp yarns may be flat resembling a ribbon or rounded and twisted yarns with an S or Z twist for example of from 1 to 3 turns per inch. In other words, the warp yarns 18 may be in various configurations. However, in lamination, the employed yarns will be compressed and generally will assume an oblong or ovoid shape. As any lamination will flatten yarns, the cross sectional appearance of the yarns in the finished product will make very little difference in the performance of the sail as long as the larger yarns do not create, after lamination, a heavy washboard appearance.

Turning now to FIG. 3, it depicts schematically in a cross sectional view a loom 21 in which a sail material 27*a* is woven. The warp yarns 18 proceed from right to left; these are drawn from appropriate storage means under maintained tension such as spools, bobbins, and the like not shown in the drawings. The warp yarns 18 are fed through a yarn feed guide 21*a* which is used in lieu of a warp beam and of a width corresponding to the desired starting point for the material to be woven. The yarn feed guide 20*a* will be described in greater detailed with reference to FIG. 11 herein and also with reference to FIGS. 4, 5, and 6 as it concerns the lateral adjustment and the desired width of the sail material 27*a*.

Number 22 designates a first set of yarn nip rollers. While weaving to provide for adjustments in width, the first set of yarn nip rollers 22, as appropriate, are disengaged from the warp yarns 18 and yarn feed guide 21 a is adjusted laterally to make the warp yarns 18 to either converge or diverge. After adjustment of the yarn feed guide 21*a*, the first set of yarn nip rollers 22 are reengaged with the warp yarns 18. Thereafter, the second set of yarn nip rollers 23 are disengaged and the lateral yarn adjustment in 21*a* is transferred simultaneously and incrementally to the first heddle assembly 24 and the second heddle assembly 25 and reed assembly 26 which are operatively, i.e., programmably interconnected with the yarn feed guide 21 a and are correspondingly adjusted. This operation would be somewhat equivalent to "letting off" in a normal weaving operation.

The mechanism for the lateral, i.e., width adjustments and the means associated therewith will be shown in FIGS. 4 and 5 herein. It is to be noted that loom 21 is operated without a warp beam, but sufficient tension on the warp is maintained by the various rollers 22 and 23. Additional set of rollers may also be used. All of the rollers may be covered with an elastomer layer which grips the warp yarns 18. A reed assembly 26 with reed segments 103 corresponding to the heddle segments 51 will be described with reference to FIGS. 11 and 12.

Shuttle 26*b* represents a conventional loom shuttle or a pick-on-pick shuttle pair or may also be a rapier shuttle or an air jet shuttle. These devices are well known in weaving the art and need not be described herein. As the woven sail material 27*a* is an open mesh scrim as shown in FIGS. 2 and 2*a*, the shuttle 26*b* and the warp yarns 18 may travel relatively fast. In other words, the fill yarns 19 being carried by the shuttle 26*b* are fairly widely spaced apart. Consequently, the weaving speed may be sacrificed to make the necessary adjustments.

The first set of fabric nip rollers 27 take off the woven sail material 27*a* from the shuttle box 26*c* (also called warp shed). Additional set(s) of nip rollers such as 27 may be employed but have not been shown. When woven and after exiting from the shuttle box 26*c*, (or warp shed) the warp yarns 18 and fill yarns 19 may also be resin coated in order to maintain adhesively a sufficient stability for the web structure of the woven sail material 27*a*. After resin application, the woven material may also be taken up on a roller (not shown) with a release paper interleaving.

The amount of resin application will also depend on the desired adhesive demand for the material and a film being laminated to the woven fabric 27*a* and the amount of adhesive on a film. Thus section 36 illustrates schematically a resin application means consisting of resin application rollers 28 which deposit the desired amount of resin 39 on the woven sail material 27*a*. Resin 39 may be a hot or cold resin and is obtained from the liquid resin holder 37 and transferred in the desired amount via transfer rollers 38 to resin application rollers 28. The resin application section 36 may be operated by keeping all rollers hot, i.e., 38 and 28 so as to transfer the hot melt resins to the sail material 27*a*. The resin application and lamination of the material may be carried out in a separate station, but for sake of efficiency, should be done as part of the weaving operation.

When laminating, each upper film roll 29 and lower film roll 30, holds a film 29*a* and 30*a* respectively. Film 29*a* and 30*a* may be the same film or a different film on each upper film roll 29 and lower film roll 30. For sake of more balanced properties, these films should be the same. As mentioned before, suitable films are polyester films such as Mylar™ or PEN polyester films and polyvinyledene chloride film such as Tedlar™. Film thickness may vary from 0.5 mills to 3 mills. A typical thickness range is about 0.75 to 2 mills.

Optionally, as indicated by the dash lines in FIG. 3, an upper additional structural member roll 31 may hold such as an X-Ply scrim or a parallel yarn scrim to add to the primary and secondary structural members, i.e., warp yarn 18 and fill yarns 19. These additional structural members 31 are deposited or placed between the film 29*a* and the woven sail material 27*a*. Similarly, the lower additional structural member roll 32 may deposit and place between the woven sail material 27*a* a lower additional structural material such as in X-Ply scrim, a parallel yarn scrim, parallel yarns, or like material designated as 32*a*. It is to be noted that neither the 3 DL™ sails or Genesis™ sails can carry, as a bottom interior layer of the laminate, an insert material such as an X-Ply. Only by adding an X-Ply and separately gluing an X-Ply and laminating the X-Ply material to the film as a separate step or adding another film may the prior art process be practiced. Films 29*a* and 30*a* may be pre-coated with a heat activatable resin which engages and holds firmly the woven sail material 27*a* and any supplemental additional members which are then joined in a unitary, finished laminated fabric 34 of only two laminated film layers exiting from the heated laminating rollers 33. Typically these laminating rollers are covered with a heat resistant material such as a silicone elastomer. These heat resistant silicone elastomers are readily available on a market such as from General Electric Co. Post curing of the laminated fabric 34 may also be achieved of the laminating fabric 34 by the take off rollers 35.

To sum up, FIG. 3 illustrates schematically a loom 21 and a method as well as means for producing a laminated sail fabric 34. Starting with warp yarns 18 and fill yarns 19 a sail material 27*a* is woven where the warp yarns 18 may progressively but incrementally diverge or converge as the yarns are woven first into a woven sail material 27*a* and then laminated into a laminated sail fabric 34.

FIG. 3*a* illustrates a yarn gathering device 90 which comes after the first set of fabric nip rollers 27. A number of pairs (not shown) of nip rollers 27 may be employed. The yarn device is employed if a corner, especially a clew, a tack and head corner, is to be made, e.g., 11*a*, 12*a*, and 14*a*, but the narrowest width of the heddle assemblies 24 and 25 and reed assembly 26 may not allow the yarns to be brought further together. At that point, the unwoven warp yarns 18 are passed through the first and second heddle assembly 24 and 25, and reed assembly 26 and the first fabric nip rollers 27 and the unwoven yarns 18 progressively narrowed by means of the device 90. The device consists of a channel 93 in which rides a protruding pin 91 on a threaded pin sleeve 91 a on each side of the web 27*a*. As the motor 94 drives the threaded rod 92, the pins 91 narrow web 27*a* in a predetermined manner. The pins 91 stop or meet at a predetermined point or a mid point 95, respectively. The midpoint 95 contains a journal for the threaded rods 92. As the gathered yarns 18 are then immediately resinated, i.e., adhesively, coated these maintain their flat shape; any additional corner finishing is then carried out by the sail maker in a conventional manner known for fiber oriented sails.

With reference to FIG. 4, this figure illustrates in a perspective view the heddle assemblies 24 and 25 as shown in FIG. 3 for one of the heddle segments 51. The heddle assemblies 24 and 25 consist of a plurality of heddle segments 51 used in a number predetermined for each panel to be woven and of a yarn spacing predetermined for each heddle segment 51 and/or for each panel. Thus, an array of heddle segments 51 will constitute the first and second heddle assemblies 24 and 25. The illustration for the heddle segment 51 is not to scale and omits details unnecessary for understanding the invention.

As in any conventional weaving process, the warp yarn 18 is in a space 44 between heddle reeds 42. Inasmuch as the yarns may be rather large, the size of the heddle reeds 42 may be correspondingly large and allow large heddle reed aperture(s) 43 to be carried by the heddle reed 42. Consequently, the yarn density per inch may be readily increased or a mixture of yarns be provided. In accordance with the present invention, the number of heddle reeds 42 per heddle reed rib 45 and 46 may be varied in any heddle segment 51 but is dependent on the desired yarn density in the sail material 27*a*, the mixture of yarns, and the desired round yarn or ribbon like appearance in the sail fabric 34. Thus, different color yarns may also be used as warp yarns 18 to give a pleasing appearance to the sail when it is hoisted and flying.

The lateral adjustment function for heddle segment 51 is achieved by two means, the gross adjustment of the heddle segment 51 and the fine adjustment of it. The gross adjustment is achieved by positioning the heddle segment 51 along a lower threaded rod 54 and an identical upper threaded rod 54. The ends of threaded rods, before a clutch 56 and the on engagement device in FIG. 10, are journalled in the heddle frame (not shown). At a mid point 53 or any point desired for a number of heddle segments 51, there is a stationary heddle segment 53*a* on a non-threaded sleeve 52*a* and rod 54 further shown in FIG. 6; the ends of threaded rods 54 are also journalled there. Each threaded rod 54 is within a threaded sleeve(s) 52 for each heddle segment 51. The threaded rod 54 drives the threaded sleeve(s) 52 back and forth, that is laterally in a cross machine direction of the loom 21. For this reason, both threaded rods carry on one side of the mid point 53 a left-handed thread and on the other side of the mid point 53 a right-handed thread and corresponding left-hand threaded and right-hand threaded sleeves 52. Accordingly, convergent or divergent weaving of the warp yarns is achieved when driving the four D.C. (direct current reversible polarity) heddle assembly motors 55. The gross adjustment is made at an identical rate with identically sized upper and lower threaded rods 54 on each of the heddle assemblies 24 and 25 as well as each of the two rods 66 for each fine adjustment device 60 of which there are two per each heddle assembly 24 and 25. The heddle assembly motor 55 is normally disengaged during the weaving operation as it will be further discussed herein. Accordingly, whenever there is a need for a movement of a heddle segment 51 either in a convergent relationship of the warp yarns 18 or a divergent relationship of warp yarns 18 for a specific panel at the start of weaving, all four heddle assembly motors 55 are engaged simultaneously and all four spread out or narrow the space between the warp yarn 18 bundles on the left and right heddle segments 51 vis-a-vis the stationary heddle segment 53*a* driving two threaded rods 54 and two threaded worm pinion rods 66. Rod 66 ends are likewise in a journal in the heddle frame (not shown) and mid point 53. For sake of illustration, a heddle assembly motor clutch 56 is shown in FIG. 4 but other engagement/disengagement means will be further shown and discussed herein.

As another embodiment, if heddle assembly motor 55 and motors clutch 56 is omitted, and threaded worm pinion rods 66 and threaded rods 54, made fast to a frame for the heddle; then only adjustment devices 60 may be used for adjustment. For such embodiment, there is also no need for a right and left-hand threads and all threads may be the same. The adjustment devices 60 then make all the adjustments in this embodiment for all of the adjustments made to converge or diverge the warp yarns 18. Corresponding changes may then be made to yarn feed guide 21 a and reed assembly 26 (not shown).

At a start of a panel weaving operation if there is a need for width adjustment, the gross adjustment is achieved by positioning the outer heddle segments 51 vis-a-vis the mid-point 53 and then making the fine adjustment by the device identified as 60 for each individual heddle segment 51. Accordingly, the worm wheel 57 is driven by the worm pinion gear 58, and it laterally positions a heddle segment 51 between an adjacent heddle segment(s) 51 starting from a point where the threaded sleeve 52 is located at the initial position after the gross adjustment has been made. This lateral movement is carried out by adjustment of all heddle segments 51 to position these after the initial gross adjustments have been made. In other words, the subsequent adjustments vis-á-vis the adjacent heddle segments 51 is made after a sufficient adjustment space has been defined by the gross adjustment. Moreover, each worm pinion gear motor 61 may be driven to position each threaded sleeve 52 and thus the heddle segment 51 were ever needed on the threaded rods 54. These adjustments allow one to obtain a sufficient control for defining a load path in each panel by the warp yarns 18 carried in each heddle segment 51. Such adjustment allows the variation in spacing between yarn bundles in different heddle segments 51 thus creating an appropriate straight line or convex or concave curvature or shape for the woven yarns in a specific heddle segments 51 in a specific panel.

In order to achieve such lateral movement, the top rib ring 47 and bottom rib ring 49 must ride in a groove 59 which is cut or provided on top of each of the top and bottom left-hand or the right-hand pair 52 threaded sleeve for each heddle segment 51. A pair of threaded sleeves 52 may carry more than one rib rig 47 and 49 respectively. These top and bottom rib rings 47 and 49, respectively, have respective top and bottom rib ring cranks 48 and 50 which are attached to a removable heddle segment 51. This facile change of the heddle segment 51 from rib cranks 48 and 50 from the heddle rib 45 and 46 respectively provide a rapid set up of the variously configured individual heddle segments 51. Conversely, the entire heddle assemblies 24 and 25 reed assembly 26, and yarn guide 21*a* may be removed and new replacements inserted.

To minimize the weight, that is mass of the heddle assemblies 24 and 25, moving up or down on each shuttle run, the worm pinion gear 58 and worm pinion motor 61 are removed during the weaving operation but are engaged with the worm wheel 57 only at an intermittent pause or a stroke of the heddle assemblies 24 and 25. A program for such engagement and disengagement is provided with the loom control means as it will be further described herein. During the intermittent delay step, the heddle assembly motor 55 and the heddle assembly motor clutch 56 are similarly engaged or disengaged. In order to achieve sufficient synchronization each worm gear pinion motor 61 is likewise mounted on a sleeve 65 carrying the worm pinion motor 61 positioned on a threaded worm pinion rod 66 not shown here but which will be further described and illustrated in FIG. 5. In its operation, the yarn feed guide 21 a and the reed assembly 26 shown in FIGS. 3, 11 and 12 are also similar but the details for these will be further described herein.

To sum up, the disclosure in FIG. 4 illustrates for a heddle segment 51 two types lateral adjustments. These adjustments may be gross and fine. Gross adjustments are on the left and right hand side of a point or midpoint 53 shown in FIG. 5 on threaded rod 54 carrying left-hand and right-hand threads. At point 53 on a threaded rod 54 is located a stationary (non-adjusted) heddle segment 53*a* and within it an inner journal for each of left-hand right-hand rods 54. For a fine adjustment, individual heddle segments 51 are individually adjusted by the device 60, i.e., by means of an intermittently engageable worm pinion gear 58 which drives worm wheel 57 and thereby adjusts threaded sleeves 52 and heddle segments 51 (i.e., after a sufficient width has been achieved for each left and right hand side for the heddle segments 51 on each side of the mid point 53). The reasons why point 53 may not be at a mid point is that different panels have different point at which the yarns 18 may diverge (or converge).

Turning now to FIG. 5, it illustrates the synchronized adjustment means 60 for the mechanism which makes the fine adjustments to the heddle segments 51 via the worm pinion gear 58 and worm wheel 57 by the pinion motor 61 and thus the transmission sleeve 65. Worm pinion transmission 62 drives worm pinion shaft 58*a* as well as transmission driven gear 63. Appropriately related transmissions of sufficiently small size are readily available on the market and coupled with a DC motor drive the transmission sleeve 65 laterally back and forth on threaded worm pinion rod 66. The worm pinion transmission 62 and the worm pinion motor 61 are mounted on the transmission sleeve 65 which has either left or right-hand threads depending on which side of the point 53 these lie. In turn, driven gear 63 drives rod gear 64. Rod gear 64 having either left-hand or right-hand threads in the interior thereof rides on the right or left-hand threaded worm pinion rod 66. For sake of clarity, two threaded worm pinion rods 66 have been shown, but there are four of these for the two heddles as will be further illustrated herein.

The number of threaded transmission sleeves 65 are equivalent to the number of threaded sleeves 52 or two for each heddle segment 51 so as to define the heddle width in the extended and contracted position for each of the heddle assemblies 24 and 25.

Again, as shown for threaded sleeves 52, the transmission sleeves 65 is free to rotate independently from the worm pinion transmission 62 and worm pinion motor 61 to which the transmission sleeve 65 is secured as shown in FIGS. 6 and 7 herein in greater detail. The synchronous adjustment is made to all of the threaded rods 54 and threaded worm pinion rods 66. The rotating transmission sleeve 65 and the driven rod gear 64 are permanently joined and are held to the worm pinion transmission 62 and the worm pinion motor 61 by the transmission bushing clamp 67 such that the transmission sleeve 65 can freely rotate between the lands 67*a* and 67*b* on the transmission sleeve 65. As shown in FIG. 5, a U-shaped channel 68 has a pin 69 (protruding from worm pinion motor 61) riding laterally in the U-shaped channel 68. As will be further discussed herein, the U-shaped channel 68 has at least two or more pneumatic cylinders 73 and 74 (not shown in FIG. 5 but shown in FIG. 9) connected thereto. Upon retraction stroke, pneumatic cylinder 73 engages the worm wheel 57 on the threaded sleeve 52 holding a heddle segment 51. Inasmuch as, the two heddle assemblies 24 and 25 are opposite images of each other, the layout is similar for each for the fine adjustment of the heddle segment 51 for both, i.e., for the first heddle assembly 24 and second heddle assembly 25. Hence, the identical details for these will not be shown. However, the engagement and disengagements of the worm pinion gear 58 with worm wheel 57 will be further discussed herein in FIG. 9.

With reference to FIG. 7, it illustrates schematically, in a left side view. the worm pinion motor 61, the worm pinion transmission 62, and the U-shaped channel 68. This view in FIG. 7 also presents the transmission sleeve 65 and the threaded worm pinion rod 66. FIG. 7 thus completes the illustrations in FIGS. 5 and 6 concerning the manner in which the fine adjustment is made to each heddle segment 51.

FIG. 8 is a top view of another embodiment in which it is depicted how a fine adjustment may be made to a heddle segment 51, a yarn guide segment in FIG. 12 and a reed segment 103 in FIG. 12. This embodiment is considerably simpler than the one shown in FIGS. 5 to 7. For this reason, the embodiment as depicted in FIG. 8 is a preferred embodiment. In FIG. 8, the worm pinion motor 61 is mounted on an offset platform 72 which in turn is attached to the transmission sleeve 65. As a result, two worm pinions gears 58 are in line and can be driven at the same ratio and the same rate along the threaded worm pinion rod 66 and threaded sleeve 52 on rod 54. Although there is more torque on pin 69 from that shown in the embodiment in FIGS. 5 to 7, pin 69 may carry at the end thereof a roller bearing (not shown) which is within the U-shaped channel 68. The advantage for this embodiment resides in the elimination of the worm pinion transmission 62. Accordingly, the two worm pinion gears 58 drive the two worm wheels 57 and 64, respectively, in a synchronous manner in an engaged position for fine adjustment of heddle segments 51, i.e., in a very positive and reliable manner.

With reference to FIG. 9, it illustrates in the left hand side view the engagement and disengagement from the threaded sleeve 52 the fine adjustment device shown in FIG. 8.

In FIG. 9, the reed assembly 26 and shuttle box 26*c* is on a left-hand side of heddle assembly 25, but these have been omitted from the drawing for sake of clarity. Take-off rollers 27 remove the scrim-like woven sail material 27*a* (shown in FIG. 3). The engagement of worm pinion gear 58 is schematically shown in FIG. 9. A first pair of double acting pneumatic cylinders 73 attached by a pivot point on U shaped channel 68 engage with the worm wheel 57 worm pinion gears 58 on the upstroke of the first heddle assembly 24 and down stroke of the second heddle assembly 25 respectively. A second of pair of double acting pneumatic cylinders 74 which have a longer stroke from that of the first pair of pneumatic cylinders 73 require the longer stroke to move the fine adjustment device 60 out of the way of the first heddle assembly 24 and second heddle assembly 25 upon their respective up and down strokes. A larger travel arc is required and has been indicated by the phantom lines in FIG. 9. Consequently, the first and second heddle assembly 24 and 25 adjustments are only made in the position shown by the fine adjustment devices 60. Accordingly, threaded rods 66 and threaded transmission sleeves 65 stay fixed and only the first and second heddle assembly 24 and 25 are reciprocating by means typically used in the art, for example, oscillatingly rotating beams and lines, cranks, cams, pneumatic cylinders, etc. (not shown). Each of the pneumatic cylinders 73 and 74 has a freely pivoting attachment point 73*a* and 74*a* respectively on a frame (not shown). By removing the weight of the fine adjustment devices 60 from the first and second heddle assemblies 24 and 25, the weight which needs to be reciprocated is also considerably reduced.

The adjustments to the heddle segments 51 are made during a shuttle run and a pause during the weaving. Inasmuch as the adjustments are first made by turning threaded rods 54 and spreading the heddle segment 51 from a point, for example, 53*a* and then subsequently adjusting each heddle segment 51 individually, the adjustment by worm pinion motor 61 may require a greater or lesser pause depending on the warp yarn lay out and fill yarn density in a particular panel. However, for each e.g., first heddle assembly 24 there are two threaded worm pinion rods 66 and each has a D.C. motor 75 shown in FIG. 5 which enable the rods to be driven synchronously forward or in reverse. Alternatively, the motors 55 and/or 75 may be replaced by means such as interconnected gears driven by a single motor (not shown) for each side of the first and second heddle assemblies 24 and 25 respectively. In order to remove as much weight as possible from first and second heddle assemblies 24 and 25 respectively, the heddle assembly motor 55 may be connected to the threaded rod 54 with a heddle assembly motor clutch 56 or with connecting means such as a splined section 54*a* on a threaded rod 54 and a complimentary splined hub 55*a* on motor 55. The splined drive arrangement is further illustrated in FIG. 10. Each of the heddle assembly motors 55 and worm pinion gear motors 61 is a D.C. motors with reverse polarity and has a forward and reverse revolution counter (not shown) subdivided in fractional segments of about 5 to 10 degrees so that the accuracy of the heddle assembly position may be maintained throughout the entire weaving operation vis-á-vis all of the gross and fine adjustment changes that are made. When making fine adjustments to yarn guide segments 83 and heddle segments 51, heddle assembly motors 55 are in an engaged position, and if necessary, a brake (not shown) may also be used. It is to be noted that for the embodiment where all of the adjustments are made only by adjustment device 60, the loom set up is considerably simpler.

With reference to FIG. 10, it illustrates, in a plan view, an embodiment which uses instead of a clutch 56, a splined hub 55*a* for heddle assembly motors 55 and a corresponding splined section 54*a* on the threaded rods 54. This embodiment insures a more positive engagement. For such an arrangement as shown in FIG. 10, the heddle assembly motors 55 are shuttled in and out of the engagement by means of an engagement device 56*a* shown in FIG. 10 as a pneumatic cylinder 56*a*. Instead of a pneumatic cylinder 56*a*, it may be a solenoid or a magnetic clutch etc. (not shown). Each of the devices 60 and the device of FIG. 10 may be used for the yarn feed device of FIG. 11 and the reed assembly 26 in FIG. 12 as all adjustments are made identically to all of the recited devices.

With reference to FIG. 1, it illustrates, in a partial front view, the arrangement for the yarn feed guide 21*a*. In its operation, it corresponds to the arrangement for laterally extending or contracting and thereafter adjusting the first and second heddle assemblies 24 and 25 as well as the reed assembly 26. However, as there is no reciprocating movement for yarn feed guide 21*a*, the gross and fine adjustment motor mechanism for adjusting the yarn feed guide 21*a* are arranged only to move in a cross machine direction, and are in an engaged position at all times. For sake of clarity, FIG. 11 depicts in a front view the gross adjustment arrangement and describes the fine adjustment by means of the device shown in FIG. 8. Locking device 85 is a U-shaped channel and holds the yarn guide segments 83 and 84. The U-shaped channel 85 in which the yarn guide segments 83 glide may be readily pivoted at pivot point 86 therefor rigidly secured to a frame (not shown). Accordingly, the left and right-hand threaded rod 80 functions in the same manner as threaded rod 54 in FIG. 4. It moves threaded sleeve 52 with worm wheel 57 by means of worm pinion gear 58. A support sleeve 81 for yarn guide segment base 82 holds a yarn guide segment 83 in a fixed position. The mid point yarn guide segment 84 does not move laterally and is a journal box 88 for threaded rods 80 and is mounted on a fixed point 87 corresponding to the fixed point 53 on threaded rod 54. If the lateral adjustments are too difficult to make due to the size of warp yarns and the tension on the wary yarns, a mirror image of the bottom adjustment devices may be provided for the top of each yarn guide segments 83. (Correspondingly also to the reed assembly 26.) With reference to FIG. 8, the fine adjustment device 60 depicted in that figure is also employed to make the fine adjustments via worm pinion gear 58 shown in FIG. 8, FIG. 11, and FIG. 12. As it is evident from FIG. 8, the fine adjustment device 60 is also mounted on the threaded worm pinion rod 66 which for sake of clarity has been omitted from FIG. 11 but shown in FIG. 12. Inasmuch as yarn feed guide 21 a does not reciprocate, both rods 80 and 66 move yarn guide segments 83 synchronously on the left and right-hand sides of the fixed point 87. Reed assembly 26, however, oscillates but the swing is small and the adjustment device 60 and the device of FIG. 10 can stay engaged with the reed assembly without removal if so desired.

As mentioned before, the desired outer (or inner) distance of an outer threaded sleeve 52 (in FIG. 4) may also be reached on both sides of the rods 80 and 66, with only the adjustment device 60 positioning each of its respective left and right-hand yarn segment guides 83.

However, typically when the desired outer (or inner) distance of an outer threaded sleeve 52 (in FIG. 4) is reached on both sides of the threaded rods 80 and 66, the fine adjustment device 60 positions each of its respective left and right-hand yarn segment guides 83. As motor 55 may now drive both yarn guide threaded rod 80 and one threaded worm pinion rod 66 synchronously, an appropriate gear connection between these rods may also be employed (not shown). Alternatively, a separate spline 54*a* and spline hub 55*a* on a motor 55 illustrated in FIG. 10 may be used for each, i.e., yarn guide threaded rod 80 and worm pinion threaded rod 66.

When operating the loom 21, the yarn feed guide 21*a* is first adjusted, then the adjustment transferred forward into a web to be woven by disengaging the first yarn nip rollers 22 while holding second yarn nip rollers 23 engaged. The distance between the first yarn nip rollers 22 and second yarn nip rollers 23 may be varied based on the degree of lateral adjustment desired for warp yarns 18. For greater adjustment, the distance between nip rollers 22 and 23 is increased and for lesser adjustment, the distance may be decreased. For large lateral adjustments, these may also be done sequentially, step-wise, and more rollers such as 23 employed. After disengagement of second nip rollers 23, a lateral adjustment is made to the first and second heddle assembly 24 and 25 respectively, and reed assembly 26 by only the adjustment device 60 as previously explained or both the FIG. 10 device and adjustment device 60.

With reference to FIG. 12, it illustrates in a side view the reed assembly 26 and reed adjustment means which in all respects is very similar to the yarn feed device 21*a*. As hard beating-up or battening is not necessary when weaving a scrim, only a slight oscillating or swing motion of the reed assembly 26 towards the web 27*a* is needed for keeping the fill yarns 19 approximately straight in a woven material. However, to accommodate the shuttle 26*b* run in a warp shed or shuttle box 26*c* (as it is well known in the art), a race plate 101 for the shuttle has been schematically indicated as in FIG. 12 which telescopically extends a telescopic member 105 from the other side of the loom 21 and travels with the last threaded sleeve 52 on each side of the web 27*a* being woven. The threaded sleeve 52, as its component part for the race plate 101, have a race plate platform 104 on which is mounted race plate 101. The same bushing clamp 67 as for adjustment device 60 is also used for the race plate. Not every race plate segment 103 needs to carry a race plate platform 104. An adequate number may be established based on the width of the web being weaved. In all other respects, the construction of the yarn guide 21*a* threaded sleeve 81 in FIG. 12 is similar. The reed segments 103 and reed assembly 26 is adjusted synchronously with the respective adjustment made to the heddle segments 51 in the first and second heddle assembly 24 and 25 respectively. Inasmuch as the same adjustment means and steps are used as for the reed assembly first and second heddle assemblies 24 and 25 and the yarn feed guide 21*a*, the sequence can be predetermined and programmed for convergent and divergent weaving. Again, the adjustments to the reed assembly 26 is made when all the other adjustments are made during weaving, i.e., during or after a pause in the shuttle 26*b* run for a length of time as needed. As the picker stick operation is well known, it has not been shown in the drawings. However, picker sticks (not shown) are only adjusted to accommodate the shuttle for the width of the web as it is being woven and may be mounted on a device similar to the yarn gathering device 90 shown in FIG. 3*a*. The gross adjustment is by the same mechanism as employed for the yarning gathering device 90 described further herein.

As the sail material 27*a* is a scrim, the fill yarns are considerably fewer than in a woven cloth material. Hence, the travel rate for sail material 27*a* web may be quite high or conversely a considerable pause can be tolerated for lateral adjustments of e.g. yarn guide segments 83, heddle segments 51, and reed segments 103. Each of the previously described adjustments may be made by a programmed computer or like control device as it is well known in the art. Programmable, multi-function control devices are supplied by manufacturers such as Siemens Co., Johnston Controls, Honeywell, Inc., etc. and are readily available on the market.

With reference to FIG. 1, it should be noted that for the clew patch 11*a* the required density of the yarns at the clew, i.e., patch corner 11*a* makes it difficult to produce during the weaving stage the required yarn density for a patch 11*a*. However, the necessary number of yarns are sufficient if passed through the heddle first and second heddle assemblies 24 and 25 and reed assembly 26 without weaving and then gathered together as shown in FIG. 3*a* with a yarn gathering-device 90, by convergently or divergently moving, i.e., laterally moving pair of pins 91 riding on a threaded pin carriage 91*a*, placed on a threaded rod 92 in a narrow slot capture channel 93, providing for moving the yarns 18 towards each other and allowing the resin to be applied to the gathered yarns 18. Thereafter, the weaving may resume after the moving pins 91 return to their widest position. The sail material roller 27 stays engaged at all times and does not allow the unwoven laterally displaced yarns to be transferred back into the reed assembly 26, and second heddle assembly 25. Although considerable yarn wastage is associated with such procedure, the panel formation such as associated with the tack and clew as well as the head can thus be carried out continuously. As shown in FIG. 3, the horizontal spacing of rollers 27, yarn gathering device 90 and laminating rollers 28 are not to scale and may be increased or decreased in spacing as needed.

As an alternative for the above-described procedure for the head patch 14*a*, clew patch 11*a*, and tack patch 12*a*, a patch construction may be employed as shown in U.S. Pat. No. 3,954,076 made of fanned and trimmed rectangles of a sailcloth may be employed. For that purpose, the final 1 to 3 inches in any panel may have many fill yarns so as to anchor better the yarns and fabric by gluing or sewing. Further, a corner sub-panel such as 17 may also be incorporated of a type as disclosed in U.S. Pat. No. 5,355,820. Finally, the entire bottom part of the sail may employ a cloth panel, e.g., for panel 15*f*, i.e., a tri-radial construction of sewn gores radiating out from the tack 12 and clew 11 and joining the fiber-oriented part of the sail above panel 15*f*, i.e., panel 15*e* shown in FIG. 1. Accordingly, the difficulties associated with corner yarn density may be met by a number of alternative embodiments in the construction of the sail and as substitutes for sub-panels 16 and 17. Nevertheless, it is emphasized that the sub-panels 16 and 17 may be made on the loom as described above (albeit with a greater trim wastage) and include an area in the panel where the warp yarns 18 are not woven. These stress transfer embodiments make the presently disclosed process eminently suitable for designing sails of great durability.

After their weaving, laminating and cutting, i.e., the panels are broad seamed, they are then glued together in a manner conventional in sail making. The finishing of the sail is also done in conventional manner.

By employment of the laminated sail fabric 34, the sail maker has an array of panel construction options available without the necessity to turn to a cloth manufacturer. The number of yarns that now carry the load may be as much as 40% greater from the yarns in prior art conventionally woven materials. The wastage associated with the sail material 34 of the present invention is far less than the wastage associated such as with as tri-radial sail construction made from cut cloth gores which wastage is of the order 15–20 percent for tri-radial sails for the conventionally woven material employed. It should be remembered that considerable number of yarns "run-of-the-thread line" in the pior art gore and panel construction. The present sail fabric 34, engages nearly all of yarns to carry substantially all the load in a more balanced, predictable manner. Thus, the invention stands out for its simplicity, ease of sail construction, and benefits conferred to the sail maker and sailing public.

The balance in the sail material is achieved by the proper employment of the herein disclosed stretch resistant continuous yarns for warp yarns, fill yarns and any supplemental insert materials such as X-Ply materials and diaxial materials.

Likewise, the film materials suitable for lamination, which have been disclosed herein, allow the design of sails of a panel construction of individually manufactured panels of outstanding properties.

What is claimed is:

1. In a process of manufacturing sail components for a triangularly shaped sail in the form of panels, wherein said panels, when incorporated in said sail, have warp yarns oriented along principal load paths in said panel comprising the steps of:

(a) weaving a panel wherein in said panel woven warp yarns are being spaced apart and are at varying angles of said warp yarns with respect to fill yarns in sail woven panel and wherein said warp yarns follow load paths for said sail panel;

(b) weaving further panels by changing said angle in said spaced apart warp yarns with respect to fill yarns and wherein warp yarns in said further panels follow load paths in said further woven panels; and (c) laminating woven panels of step (a) and (b); and (d) incorporating said panels of steps (a), (b), and (c) including additional panels, in said triangularly shaped sail.

2. In the process as defined in claim 1 wherein each woven panel of steps (a) and (b) is for the same sail.

3. The process as defined in claim 1 wherein each woven panel of steps (a) and (b) is for a different sail and, as woven panels are opposite images of each other along said warp yarns.

4. The process as defined in claim 1 wherein each panel for said sail is woven with its successive complimentary panel for said sail.

5. The process as defined in claim 1 wherein each panel is woven of polyaramid polymer warp yarns and a polyaramid polymer fill yarns.

6. The process as defined in claim 1 wherein each panel is woven of polyaramid polymer warp yarns and polyester polymer fill yarns and wherein the polyaramid polymer warp yarns are from 150 to 1500 deniers in size and the polyester fill yarns are from 100 to 1,000 deniers in size.

7. The process as defined in claim 1 wherein said warp yarns in a panel are spaced apart from 1 yarn/in to 5 yarns/in and are incrementally and progressively adjusted to follow load paths in said panel and wherein said fill yarns are spaced apart at about one fill yarn per two inches to three fill yarns per inch in said woven panel.

8. The process as defined in claim 1 wherein during weaving of said warp yarns, a segment of warp yarns is independently adjustable vis-á-vis adjacent segments of warp yarns on each side of said segment of warp yarns and said segment of warp yarns is adjustable with respect to warp yarns on the opposite sides of said panel.

9. The process as defined in claim 1 wherein during weaving of a panel, a segment of warp yarns is independently and incrementally divergently or convergently adjusted synchronously vis-a-vis an adjacent segment of warp yarns.

10. The process as defined in claim 1 including a further step of laminating each woven panel, said laminating being two sided, and at least one side of said woven panel is laminated with a polyester polymer film.

11. The process as defined in claim 10 including a step of laminating each woven panel on at least a bottom side thereof, said laminating being with a pre-coated film having an adhesive thereon activatable upon application of heat.

12. The process as defined in claim 10 wherein said laminating is of both surfaces of said woven panel and wherein a surface of said panel is laminated with a polyester film and includes an X-Ply insertion between said film and woven panel and said film further includes a heat curable adhesive to attach to said woven panel.

13. The process as defined in claim 10 wherein said laminating is with a polyester polymer film and an X-ply material of polyaramid polymer yarns between said film and said panel on the bottom of a woven panel.

14. The process as defined in claim 10 wherein a further step of laminating of said panel is with a polyester taffeta material on one surface of said panel.

15. As an article of manufacture, a sail of a panel construction of an approximately triangular shape which in use and for an intended purpose has principal load paths in said sail between a tack and a clew, a tack and a head, and a clew and a head, said sail comprising at least one panel of a woven material of spaced apart warp yarns wherein said warp yarns in said woven material are disposed along said principal load paths in said sail and include fill yarns in said woven material at varying angles vis-á-vis said warp yarns for said woven material, and said woven warp yarns predeterminately disposed along said load paths from said clew, tack, and head in each panel of said sail.

16. The sail as defined in claim 15 wherein said sail is comprised of a plurality of panels of woven materials of warp and fill yarns wherein in each panel warp yarns substantially follow principal load paths in said panel along the lines of said load paths in said sail from clew to head when said sail is in use and wherein in said woven material fill yarns are at varying angles to said warp yarns along said load paths from panel to panel and said warp and fill yarns are spaced apart from each other from 1 yarn/in to 16 yarns/in.

17. The sail as defined in claim 15 wherein said sail panels of woven material warp yarns in said panels are disposed along said load paths in said panel and wherein a panel has at least one sub panel.

18. The sail as defined in claim 15 wherein said warp yarns consist of a bundle of filament fiber yarns of polyaramid, polyester, polyolofin, polyphenylene para benzo bisoxazole, carbon fibers or mixtures of same.

19. The sail as defined in claim 18 wherein filament fiber yarns of carbon have a sheath of polyester polymer on a surface thereof.

20. The sail as defined in claim 15 wherein said fill yarns are of filament fiber yarns of polyester, polyaramid, polyolefin, carbon, poly phenylen para benzo bis oxazole, or polyamide and wherein each warp yarn and fill yarn is spaced apart from their respective adjacent yarns from about 1/16 in. to 1 in.

* * * * *